US007471256B2

(12) United States Patent
Kwon et al.

(10) Patent No.: US 7,471,256 B2
(45) Date of Patent: Dec. 30, 2008

(54) SUBSTRATE TYPE DIPOLE ANTENNA HAVING STABLE RADIATION PATTERN

(75) Inventors: Do-hoon Kwon, Seoul (KR); Yong-jin Kim, Seoul (KR); Seong-soo Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 206 days.

(21) Appl. No.: 11/322,351

(22) Filed: Jan. 3, 2006

(65) Prior Publication Data

US 2006/0158383 A1 Jul. 20, 2006

Related U.S. Application Data

(60) Provisional application No. 60/644,030, filed on Jan. 18, 2005.

(30) Foreign Application Priority Data

Mar. 12, 2005 (KR) ..... 10-2005-0020780

(51) Int. Cl.
*H01Q 9/28* (2006.01)

(52) U.S. Cl. ..... 343/795

(58) Field of Classification Search ..... 373/795, 373/865, 700 MS, 767, 829–830, 770
See application file for complete search history.

(56) References Cited

U.S. PATENT DOCUMENTS

| | | | | |
|---|---|---|---|---|
| 5,872,546 | A * | 2/1999 | Ihara et al. | 343/795 |
| 6,348,898 | B1 * | 2/2002 | Rosenbury et al. | 343/786 |
| 6,351,246 | B1 * | 2/2002 | McCorkle | 343/795 |
| 6,642,903 | B2 * | 11/2003 | Schantz | 343/795 |
| 7,042,401 | B2 * | 5/2006 | Park et al. | 343/700 MS |
| 7,158,089 | B2 * | 1/2007 | Mohammadian et al. | 343/795 |
| 7,176,837 | B2 * | 2/2007 | Sonoda et al. | 343/700 MS |
| 2004/0036655 | A1 * | 2/2004 | Sainati et al. | 343/702 |

* cited by examiner

*Primary Examiner*—Huedung Mancuso
(74) *Attorney, Agent, or Firm*—Sughrue Mion, PLLC

(57) ABSTRACT

A Ultra WideBand (UWB) substrate type dipole antenna is provided which has a stable radiation pattern. The UWB substrate type dipole antenna includes a dielectric substrate, a first radiator formed on a side of the dielectric substrate, a signal line transmitting an energy from a coaxial cable to the first radiator, and a plurality of second radiators formed at a predetermined distance from the first radiator and the signal line, and respectively having therein a plurality of slits of a predetermined configuration. Because there is no leakage of electric current to an outer part of an external conductor of the coaxial cable, even when the connection of the connector and the coaxial cable to the antenna, distortion of the radiation pattern of the antenna is prevented. As a result, the same radiation pattern and the direction of maximum radiation may be obtained before and after connection with the connector and the coaxial cable.

16 Claims, 4 Drawing Sheets

SUBSTRATE TYPE DIPOLE ANTENNA HAVING STABLE RADIATION PATTERN

CROSS-REFERENCE TO RELATED APPLICATIONS

This application claims priority from U.S. provisional application No. 60/644,030, filed Jan. 18, 2005, and from Korean Patent Application No. 10-2005-0020780, filed Mar. 12, 2005, the entire disclosures of which are incorporated herein by reference.

BACKGROUND OF THE INVENTION

1. Field of the Invention

The present invention relates to a substrate type dipole antenna, and, more particularly, to an ultra-band substrate type dipole antenna which blocks leakage current on an outer part of an external conductor of a coaxial cable and therefore prevents distortion of a radiation pattern.

2. Description of the Related Art

With the industrialization of Ultra WideBand (UWB) wireless communication technologies, various UWB wireless communication technologies are expected to be applied to personal computers, electronic appliances, and personal wireless terminals, etc. Accordingly, an antenna technology, which can provide a low price unit, compact size and maximum electric performance, is also required. Generally, a substrate type antenna by a printed circuit board technique is a representative example of a reasonable-price antenna for use in a ultra wideband. A variety of dipole antennas are fabricated in the category of the substrate type antennas, as exemplarily disclosed in U.S. Pat. No. 6,642,903.

FIG. 1 is provided for explanation of one example of electric current feed to a substrate type antenna. An antenna 10 is connected with a coaxial cable 30 to transmit and receive electric waves. Referring to FIG. 1, feed is performed with respect to the antenna through the coaxial cable 30 which is connected to the lower part of the connector 20.

Generally, in designing substrate type antennas, a metal pattern is used in the substrate so that high frequency electric current can flow. Additionally, an antenna is designed to have maximum radiation in the vertical direction with respect to the substrate plane and also in the left and right direction of the antenna. Meanwhile, the radiation pattern of an antenna is influenced by the electric current flowing there through. Therefore, a leakage of electric current may occur on an outer part of an external conductor of the coaxial cable 30 when the coaxial cable 30 is connected to the antenna. Due to such leakage of electric current, the radiation pattern of the antenna changes, and therefore, the maximum radiation that the designer originally anticipated is not obtained.

FIG. 2 shows the change of radiation pattern based on the antenna, when the feed method of FIG. 1 is employed. Referring to FIG. 2, the maximum radiation is deviated to the coaxial cable 30 due to partial leakage of electric current toward the outer part of the external conductor of the coaxial cable 30 when the electric current is fed to the antenna.

In order to reduce the above-mentioned problems, a feed method as shown in FIG. 3 has been conventionally suggested. Another example of electricity feed to the substrate type antenna will be briefly described below with reference to FIG. 3.

As shown in FIG. 3, an antenna with a 90° bent coaxial cable has a leakage of electric current in the direction of the coaxial cable, and therefore, the problem of having a shift of the maximum radiation of the antenna from the vertical direction of the antenna surface to the connector can be somewhat reduced. However, this type of electric feed has an interference of electric waves between the antenna and the coaxial cable due to the perpendicular orientation of the coaxial cable with respect to the antenna substrate. Therefore, the radiation pattern of the antenna varies from the uniform pattern.

SUMMARY OF THE INVENTION

Accordingly, it is an aspect of the present invention to provide a UWB (Ultra WideBand) substrate type dipole antenna, which is capable of preventing leakage of electric current on an outer part of an external conductor of a coaxial cable and subsequently achieving a stabilized radiation pattern.

The above and other aspects of the present invention may be substantially achieved by providing a substrate type dipole antenna, including a dielectric substrate, a first radiator disposed on a side of the dielectric substrate, a signal line that transmits energy from a coaxial cable to the first radiator, and a plurality of second radiators disposed at a predetermined distance from the first radiator and the signal line, the plurality of second radiators respectively having therein a plurality of slits of a predetermined configuration.

The first radiator, the signal line, and the plurality of second radiators may be formed by etching in a predetermined pattern in a conductive material that is deposited on the dielectric substrate, and each of the first radiator, the signal line, and the plurality of second radiators may be positioned on an identical plane of the dielectric substrate.

The first radiator, the signal line, and the plurality of second radiators may be disposed on the dielectric substrate according to a coplanar waveguide (CPW) electric feed method.

The signal line may be disposed from the lower side of the center of the dielectric substrate to the lower side of the center of the first radiator.

The plurality of radiators may be disposed in mirror-symmetry with reference to the signal line, and the plurality of radiators are formed at a predetermined distance from the signal line.

The plurality of slits may be formed by etching the plurality of second radiators in accordance with a predetermined pattern.

The plurality of slits may each have an upper width that is wider than a lower width.

The slits may each have an upper width and a lower width that are identical.

The distance between the plurality of slits and the signal line may be maintained based on a predetermined threshold.

The plurality of slits may block the electric current flowing on the second radiators from transmitting to the coaxial cable.

The lower width of the slits may be approximately from 1 mm to 3 mm.

The length of the longer side of the dielectric substrate may be approximately 32.7 mm, and the length of the shorter side of the dielectric substrate may be approximately 23 mm.

According to one aspect of the present invention, a substrate type dipole antenna is provided, including a dielectric substrate, a first radiator disposed on a first side of the dielectric substrate, a signal line that transmits energy from a coaxial cable to the first radiator, and a second radiator disposed on a second side of the dielectric substrate that is opposite to the first side on which the first radiator is formed, the second radiator including a plurality of slits of a predetermined configuration therein.

The first radiator and the signal line may be positioned on an identical plane, and the second radiator may be positioned on a plane that is different from the plane that the first radiator and the signal line are positioned on.

The first radiator, the signal line and the second radiator may be disposed on the dielectric substrate according to a microstrip electric feed method.

The plurality of slits may block electric current flowing on the surface of the second radiator from transmitting to the coaxial cable.

BRIEF DESCRIPTION OF THE DRAWINGS

The above and other aspects of the present invention will be more apparent by describing certain exemplary embodiments of the present invention with reference to the accompanying drawings, in which.

DETAILED DESCRIPTION OF THE EXEMPLARY EMBODIMENTS OF THE INVENTION

Exemplary embodiments of the present invention will be described herein below with reference to the accompanying drawings.

Figure 1:
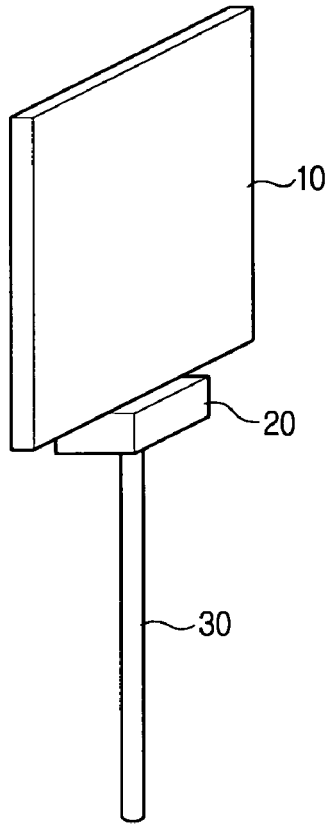
FIG. 1 (PRIOR ART)
FIG. 1 is a view provided for explanation of an example of an electric feed method for a substrate type antenna.
Figure 2:
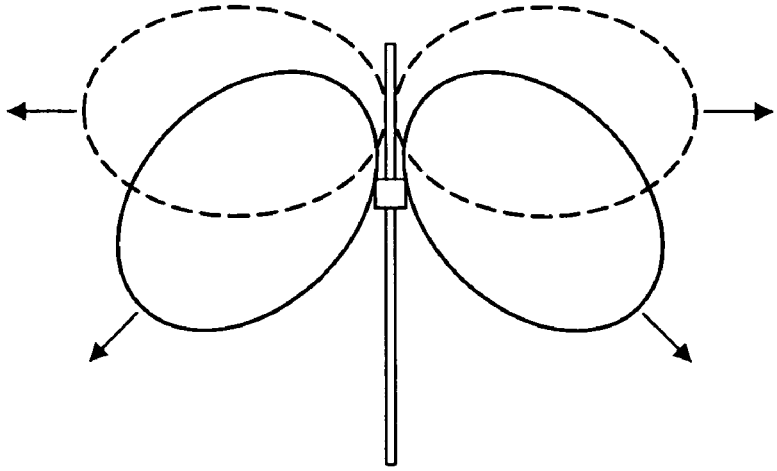
FIG. 2 (PRIOR ART)
FIG. 2 is a view illustrating the change of radiation pattern based on the antenna, when the feed method of FIG. 1 is employed.
Figure 3:
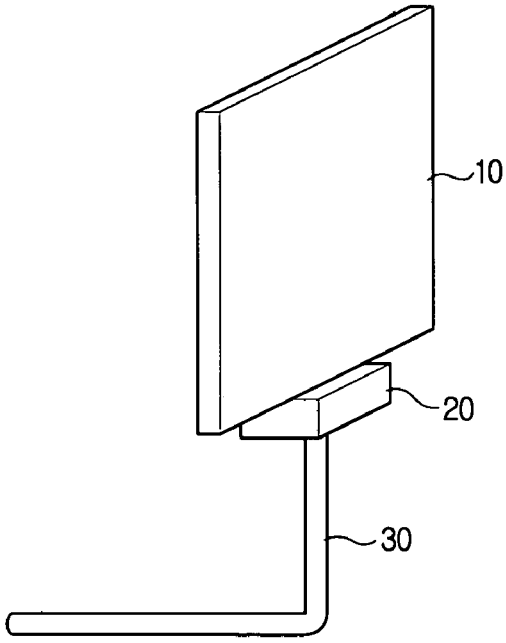
FIG. 3 (PRIOR ART)
FIG. 3 is a view provided for the explanation of another example of an electric feed method for a substrate type antenna.
Figure 4:
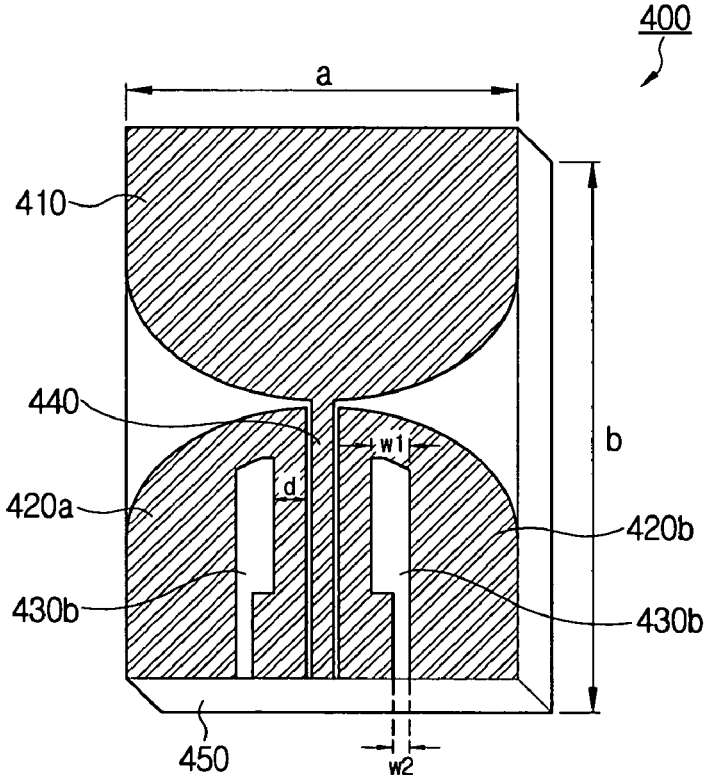
FIG. 4 is a view illustrating a UWB (Ultra WideBand) substrate type dipole antenna of CPW (Coplanar waveguide) electric feed method according to a first exemplary embodiment of the present invention.

FIG. 4 is a view illustrating a Ultra WideBand (UWB) substrate type dipole antenna utilizing a coplanar waveguide (CPW) electric feed method according to a first exemplary embodiment of the present invention. Referring to FIG. 4, a UWB substrate type dipole antenna utilizing a CPW electric feed according to the first exemplary embodiment of the present invention includes a dielectric substrate 450, a first radiator 410 formed by coating a conductor on the same upper plane of the dielectric substrate 450, a signal line 440, and a plurality of second radiators 420*a* and 420*b*. The first radiator 410, the signal line 440 and the plurality of second radiators 420*a* and 420*b* may be formed by coating with a printed circuit board processing technique.

The first radiator 410, the plurality of second radiators 420*a* and 420*b*, and the signal line 440 are formed by etching a single conductor in a predetermined pattern, and the signal line 440 and the first radiator 410 are directly connected with each other. The plurality of second radiators 420*a* and 420*b* are distanced apart from the first radiator 410 and the signal line 440. Further, the conductors may be tinned to prevent corrosion.

In this particular exemplary embodiment of the present invention, the length (b) of the longer side of the dielectric substrate 450 is approximately 32.7 mm, and the length (a) of the shorter side is approximately 23 mm.

With reference to FIG. 4, the upper side of the first radiator 410 has substantially rectangular configuration, and the lower side is tapered. However, one will understand that the lower side of the first radiator 410 is not limited to the tapered configuration. For example, the lower side of the first radiator 410 may be formed in various configurations such as an inverted triangle. The lower center of the first radiator 410 is directly connected with the signal line 440.

The plurality of second radiators 420*a* and 420*b* are arranged in a mirror-symmetrical pattern at a predetermined distance from each other with respect to the signal line 440. Leakage current prevention slits 430*a* and 430*b* are formed by etching in the conductor of the second radiators 420*a* and 420*b*, respectively. The leakage current prevention slits 430*a* and 430*b* each have an upper width (w1) that is wider than the lower width (w2). However, the configuration of the slits 430*a* and 430*b* is not limited to the configuration shown in FIG. 4. For example, the slits 430*a* and 430*b* may have upper width (w1) that is identical to the lower width (w2).

In order for the antenna to have wide bandwidth, the slits 430*a* and 430*b* may be formed narrow in size. However, if the slits 430*a* and 430*b* are sized too narrow, electric current flowing in the second radiators 420*a* and 420*b* will flow through the coaxial cable (not shown) through capacitive coupling, which will subsequently change the radiation pattern. Accordingly, the width of the slits 430*a* and 430*b* is determined adequately, and in this exemplary embodiment, the adequate width of the lower side of the slits 430*a* and 430*b* may be approximately from about 1 mm to about 3 mm.

Meanwhile, the slits 430*a* and 430*b* are formed to have a predetermined threshold distance (d) from the signal line 440 in order not to be placed too close to the signal line 440. In wideband applications, it may be preferable that the characteristic impedance of the antenna is maintained at approximately 50 ohms. However, if the slits 430*a* and 430*b* are formed close to the signal line 440, for example, if they are formed in the predetermined threshold distance (d) with the signal line 440, the characteristic impedance of the antenna greatly varies due to the change of frequency. Thus, the threshold distance (d) between the slits 430*a* and 430*b* and the signal line 440 is the parameter which can be determined to an appropriate value by the experiments.

Figure 5A:
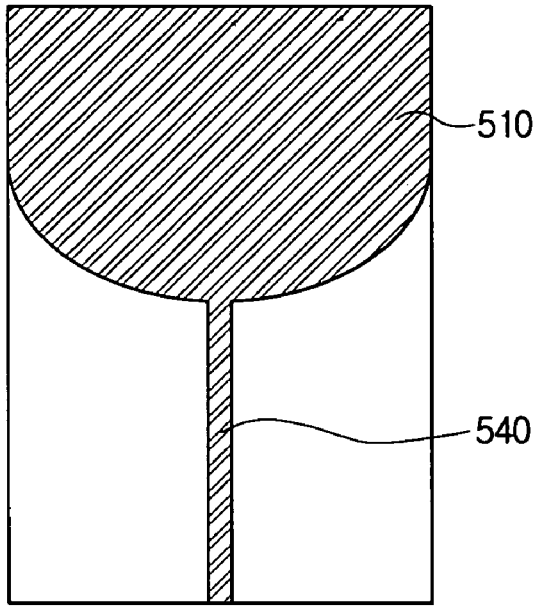
FIGS. 5A and 5B are plan view and rear view each showing an UWB (Ultra WideBand) substrate type dipole antenna of microstrip electric feed according to a second exemplary embodiment of the present invention.
Figure 5B:
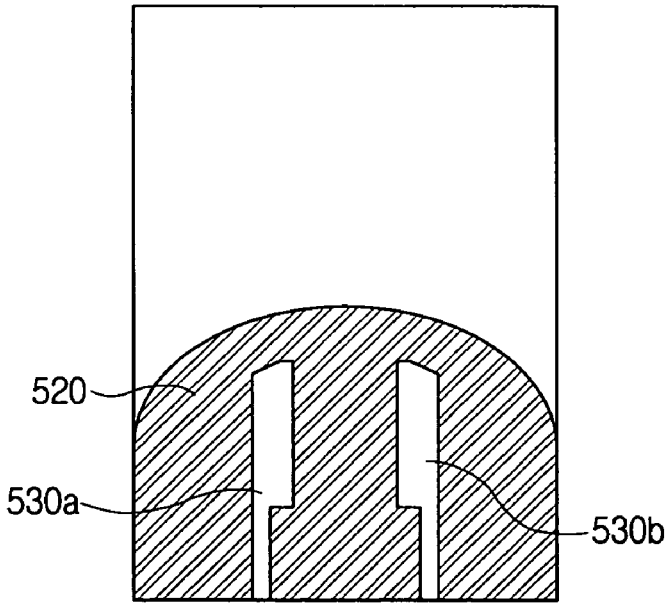

FIGS. 5A and 5B are a plan view and a rear view, respectively, of a UWB substrate type dipole antenna of a microstrip feed method according to a second exemplary embodiment of the present invention.

Referring to FIGS. 5A and 5B, the microstrip feed method according to the second exemplary embodiment includes the first radiator 510 and the signal line 540 formed on the same plane of the dielectric substrate. However, unlike the CPW feed method, the microstrip feed method includes the second radiator 520 on an opposite plane from the first radiator 510 and the signal line 540. More specifically, the second radiator 520 of the microstrip feed method is formed on the base lower side of the dielectric substrate.

Figure 6:
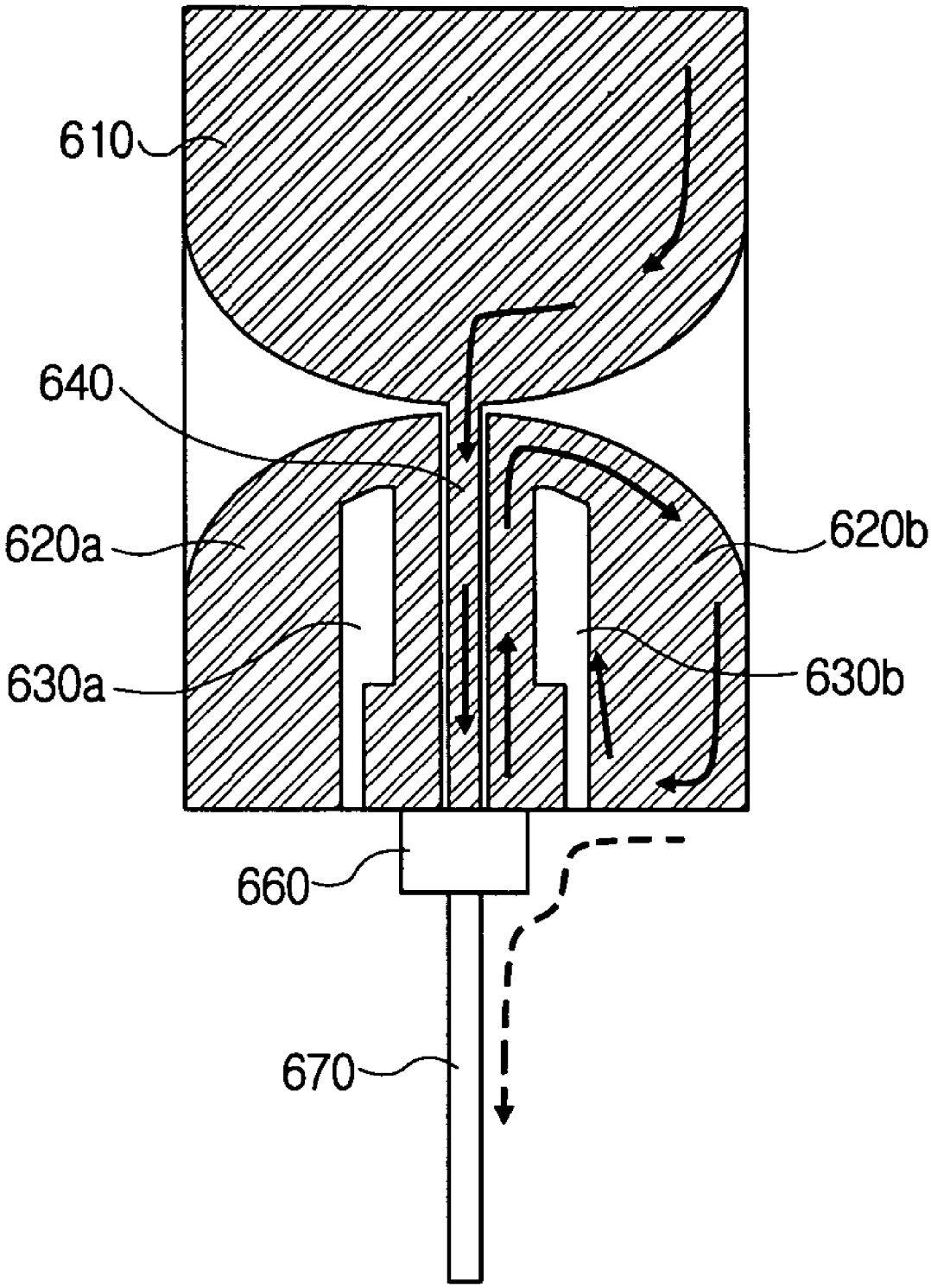
FIG. 6 is a conceptual diagram provided for explanation of an operational principle according to an exemplary embodiment of the present invention, with reference to the antenna of FIG. 4.

FIG. 6 is a conceptual view provided for explanation of an operational principle according to an exemplary embodiment of the present invention, with reference to the antenna of FIG. 4.

In the planar feed methods such as CPW or microstrip structure, the energy, which is transmitted through the coaxial cable 670, is transmitted to the plurality of second radiators 620*a* and 620*b* through the connector 660, and then transmitted to the first radiator 610 through the connector 660 and the signal line 640.

As shown by the solid line arrows of FIG. 6, the energy at the first radiator 610 and the plurality of second radiators 620*a* and 620*b* are represented in the form of movement of electric current at the surface of the first radiator 610 and the plurality of second radiators 620*a* and 620*b*.

The electric current flowing at the surface of the plurality of second radiators 620*a* and 620*b* would have decreased intensity of electric current as the electric current is blocked by the plurality of slits 630*a* and 630*b*, respectively. Accordingly, the electric current flowing at the surface of the second radiators 620*a* and 620*b* does not flow to an outer part of the external conductor of the coaxial cable 670. As a result, there is no leakage of electric current on an outer part of the external conductor of the coaxial cable 670. The phantom line of FIG. 6 shows that there is no leakage of electric current on an outer part of the coaxial cable 670.

As described above in a few exemplary embodiments of the present invention, the electric current flowing on the surface of the second radiators 620*a* and 620*b* is blocked from flowing to the coaxial cable 670 due to the presence of the slits 630*a* and 630*b* that are formed in the second radiators 620*a* and 620*b*. As a result, no leakage of electric current occurs on an outer part of the external conductor of the coaxial cable 670.

Accordingly, a change of the radiation pattern due to the leakage of electric current on an outer part of the external conductor of the coaxial cable is prevented. Thus, a substrate type dipole antenna, which can have maximum radiation in the exact direction as intended by the designer, can be provided.

As described above in a few exemplary embodiments of the present invention, even when the connector and the coaxial cable are connected to the substrate dipole antenna, electric current does not leak to an outer part of the external conductor of the coaxial cable, and distortion of radiation pattern is prevented. As a result, the same radiation pattern and direction of maximum radiation can be obtained before and after the connection of the connector and the coaxial cable to the antenna.

The foregoing embodiments are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A substrate type dipole antenna, comprising:

a dielectric substrate;

a first radiator disposed on a side of the dielectric substrate;

a signal line that transmits energy from a coaxial cable to the first radiator; and a plurality of second radiators disposed at a predetermined distance from the first radiator and the signal line, the plurality of second radiators respectively including therein a plurality of slits of a predetermined configuration;

wherein the first radiator, the signal line, and the plurality of second radiators are formed by etching a predetermined pattern in a conductive material that is deposited on the dielectric substrate.

2. The substrate type dipole antenna of claim 1, wherein each of the first radiator, the signal line, and the plurality of second radiators are positioned on an identical plane of the dielectric substrate.

3. The substrate type dipole antenna of claim 2, wherein the first radiator, the signal line, and the plurality of second radiators are disposed on the dielectric substrate according to a coplanar waveguide (CPW) electric feed method.

4. The substrate type dipole antenna of claim 1, wherein the signal line is disposed from the lower side of the center of the dielectric substrate to the lower side of the center of the first radiator.

5. The substrate type dipole antenna of claim 1, wherein the plurality of radiators are disposed in mirror-symmetry with reference to the signal line, and the plurality of radiators are disposed at a predetermined distance from the signal line.

6. The substrate type dipole antenna of claim 1, wherein the plurality of slits are formed by etching the plurality of second radiators in accordance with a predetermined pattern.

7. The substrate type dipole antenna of claim 6, wherein the plurality of slits each have an upper width that is wider than a lower width.

8. The substrate type dipole antenna of claim 6, wherein the slits each have an upper width and a lower width that are identical.

9. The substrate type dipole antenna of claim 6, wherein a distance between the plurality of slits and the signal line is maintained based on a predetermined threshold.

10. The substrate type dipole antenna of claim 6, wherein the plurality of slits block the electric current that flows on the second radiators from transmitting to the coaxial cable.

11. The substrate type dipole antenna of claim 6, wherein a lower width of the slits is approximately from 1 mm to 3 mm.

12. The substrate type dipole antenna of claim 6, wherein a length of a longer side of the dielectric substrate is approximately 32.7 mm, and a length of a shorter side of the dielectric substrate is approximately 23 mm.

13. A substrate type dipole antenna, comprising:

a dielectric substrate;

a first radiator disposed on a first side of the dielectric substrate;

a signal line that transmits energy from a coaxial cable to the first radiator; and a second radiator disposed on a second side of the dielectric substrate that is opposite to the first side on which the first radiator is disposed, the second radiator including a plurality of slits of a predetermined configuration therein;

wherein the first radiator, the signal line, and the plurality of second radiators are formed by etching a predetermined pattern in a conductive material that is deposited on the dielectric substrate.

14. The substrate type dipole antenna of claim 13, wherein the first radiator and the signal line are positioned on an identical plane, and the second radiator is positioned on a plane that is different from the plane that the first radiator and the signal line are positioned on.

15. The substrate type dipole antenna of claim 13, wherein the first radiator, the signal line and the second radiator are disposed on the dielectric substrate according to a microstrip electric feed method.

16. The substrate type dipole antenna of claim 13, wherein the plurality of slits block electric current that flows on the surface of the second radiator from transmitting to the coaxial cable.

* * * * *